US010844639B2

(12) United States Patent
Nelsen

(10) Patent No.: US 10,844,639 B2
(45) Date of Patent: Nov. 24, 2020

(54) E-LATCH WITH MECHANICAL BACKUP AND ELECTRONIC OVERRIDE CANCEL FEATURE

(71) Applicants: Hyundai America Technical Center, Inc, Superior Township, MI (US); Hyundai Motor Company, Seoul (KR); Kia Motors Corporation, Seoul (KR)

(72) Inventor: James Nelsen, Howell, MI (US)

( * ) Notice: Subject to any disclaimer, the term of this patent is extended or adjusted under 35 U.S.C. 154(b) by 1076 days.

(21) Appl. No.: 15/168,715

(22) Filed: May 31, 2016

(65) Prior Publication Data

US 2017/0342749 A1 Nov. 30, 2017

(51) Int. Cl.

| | |
|---|---|
| ***E05B 81/90*** | (2014.01) |
| ***E05B 79/10*** | (2014.01) |
| ***E05B 81/06*** | (2014.01) |
| ***E05B 81/42*** | (2014.01) |
| ***E05B 85/24*** | (2014.01) |

(52) U.S. Cl.

CPC ..... *E05B 79/10* (2013.01); *E05B 81/06* (2013.01); *E05B 81/42* (2013.01); *E05B 81/90* (2013.01); *E05B 85/243* (2013.01); *Y10T 292/1047* (2015.04); *Y10T 292/1082* (2015.04)

(58) Field of Classification Search

CPC ..... Y10T 292/1047; Y10T 292/1082

See application file for complete search history.

(56) References Cited

U.S. PATENT DOCUMENTS

| | | | | |
|---|---|---|---|---|
| 4,763,936 A * | 8/1988 | Rogakos | E05B 81/14 | 292/201 |
| 5,454,608 A * | 10/1995 | Dzurko | E05B 81/90 | 292/216 |
| 5,537,848 A * | 7/1996 | Grzanka | E05B 81/16 | 292/201 |
| 5,715,713 A * | 2/1998 | Aubry | E05B 81/06 | 292/201 |
| 6,045,168 A * | 4/2000 | Johnson | E05B 77/28 | 292/216 |
| 6,053,542 A * | 4/2000 | Ostrowski | E05B 81/20 | 292/201 |
| 6,517,128 B2 * | 2/2003 | Perkins | E05B 81/14 | 292/201 |
| 6,520,549 B1 * | 2/2003 | Kalsi | E05B 81/14 | 292/201 |
| 6,705,140 B1 * | 3/2004 | Dimig | E05B 81/06 | 292/201 |

(Continued)

FOREIGN PATENT DOCUMENTS

| | | |
|---|---|---|
| CN | 101657590 A | 2/2010 |
| CN | 102312619 A | 1/2012 |

(Continued)

*Primary Examiner* — Carlos Lugo

(57) ABSTRACT

A latch assembly and a method of disengaging the latch assembly for a vehicle door are provided. In particular, the latch assembly includes a releasing lever that is moveably attached to the latch assembly via a pawl and is moveable between an engaged and disengaged position to unlatch the latch assembly. Additionally, a lock lever interacts with an override assembly to control whether the vehicle door is opened. The override assembly requires two movements to move the lock lever to an unlocked position and to open the latch during a power failure.

14 Claims, 17 Drawing Sheets

(56) References Cited

U.S. PATENT DOCUMENTS

| | | | | |
|---|---|---|---|---|
| 6,719,333 | B2 * | 4/2004 | Rice | E05B 81/14 292/201 |
| 6,793,255 | B2 * | 9/2004 | Kobayashi | E05B 77/30 292/216 |
| 7,448,237 | B2 * | 11/2008 | Shimada | E05B 77/34 292/201 |
| 7,827,836 | B2 | 11/2010 | Cetnar | |
| 8,141,916 | B2 * | 3/2012 | Tomaszewski | E05B 77/26 292/201 |
| 2003/0094024 | A1 | 5/2003 | Dimig | |
| 2006/0103145 | A1 * | 5/2006 | Ottolini | E05B 81/14 292/216 |
| 2011/0204673 | A1 | 8/2011 | Cumbo et al. | |
| 2012/0061976 | A1 * | 3/2012 | Tostado | E05B 77/30 292/200 |
| 2014/0075847 | A1 | 3/2014 | Konchan | |
| 2015/0204118 | A1 * | 7/2015 | Cetnar | E05B 77/02 292/197 |
| 2016/0069106 | A1 * | 3/2016 | Rudraraju | E05B 85/20 292/196 |

FOREIGN PATENT DOCUMENTS

| | | | |
|---|---|---|---|
| CN | 104956019 | A | 9/2015 |
| CN | 105545126 | A | 5/2016 |
| JP | 2005-290907 | A | 10/2005 |
| JP | 4516613 | B2 | 8/2010 |
| KR | 10-0372459 | B1 | 2/2003 |
| KR | 10-2006-0049610 | A | 5/2006 |
| KR | 10-2009-0064225 | A | 6/2009 |
| KR | 10-2015-0014891 | A | 2/2015 |
| KR | 10-2016-0026253 | A | 3/2016 |

* cited by examiner

E-LATCH WITH MECHANICAL BACKUP AND ELECTRONIC OVERRIDE CANCEL FEATURE

BACKGROUND

1. Field of the Disclosure

The present disclosure relates to a latch assembly of a vehicle door with an emergency mechanical release, and more particularly, to an emergency mechanical release that is capable of maintaining a rear door lock feature using a single motor.

2. Description of the Related Art

Generally, vehicles today are being developed with electrically released door latches to reduce the likelihood of opening during vehicle crashes due to the inertia or deformation of the mechanical release mechanism and to improve vehicle aesthetics by eliminating or reducing the size of exterior handles. These types of electronically released latches ("e-latches") are typically equipped with a type of backup system for vehicle doors used during emergency situations such as a dead battery, power failure, or vehicle accident causing loss of power. Various different types of electronic latch systems have been developed with mechanical and electronic emergency backup features. The developed systems known in the related art typically include a power release with an emergency manual function possibility, or a power release together with an electronic control unit and energy storage for backup.

Particularly, a developed system of the related art includes a manually operated release lever that is rotatable between a disengaged and engaged position. This type of backup system is often disposed somewhere within the vehicle, thus requiring a passenger to be able to locate the release during an emergency situation. Evidence from field experience suggests that in these situations, not all occupants will be able to find an emergency release that is not located in an obvious location, and such an obviously located feature may not be able to effectively provide child lock or double locking features, nor meet the intent of regulations regarding the prohibition of a single motion release on rear doors.

Additionally, mechanical release systems have been developed wherein the backup system is controlled by a second motor that selectively locks out the interior mechanical release handle under certain circumstances, such as when the vehicle is moving, or the child lock is engaged, or double or safe locking is applied to a parked vehicle. However, in such a system there is a possibility that the system remains engaged after a vehicle accident or power failure, thus increasing the risk of passenger entrapment.

Another type of emergency backup system that has been developed in the related art is a system that is completely electronic in nature. This system requires a separate power source from the vehicle battery, typically consisting of a small battery or a bank of supercapacitors disposed within the latch or in a location within the vehicle that is considered safe from impact damage. This system also requires a type of electronic controller, onboard the latch or elsewhere within the vehicle, capable of sensing a power loss situation and providing for safe and secure opening of the door in the event of an emergency situation.

Further, in the current technologies of the related art, electronic backup systems are expensive and reduce advantages in weight. Additionally, current mechanical backup systems eliminate advantages of an electronic latch system and may be difficult to implement due to the requirement of continuously providing a child lock to disable an inside release (e.g., inside handle) and the aforementioned legal requirement of two separate motions to open a door. Accordingly, an improvement is needed for backup of an e-latch to enter a vehicle when a battery has failed and to exit a vehicle after an accident or a power loss.

The above information disclosed in this section is merely for enhancement of understanding of the background of the disclosure and therefore it may contain information that does not form the prior art that is already known in this country to a person of ordinary skill in the art.

SUMMARY

The present disclosure provides an emergency mechanical release for a latch assembly of a vehicle door during a power failure and maintaining a child lock feature and a two-motion opening feature when power is available to the latch by the vehicle battery.

According to one aspect of the present disclosure, a latch assembly for a vehicle door is provided that comprises a releasing lever moveably attached to the latch assembly via a pawl. In addition, a hold open lever is engageable with the releasing lever to maintain the releasing lever in a disengaged position. The hold open lever is moveably secured to the latch assembly via a rotatable pivot. A lock lever interacts with an override assembly to control whether the vehicle door is opened. The override assembly requires two movements to move the lock lever to an unlocked position and to open the latch during a power failure.

In an additional aspect, the override assembly includes an override lever that interfaces with the lock lever and a spring that is coupled to the override lever and is in communication with an outer surface of the lock lever. Additionally, an inside release lever is capable of coupling and decoupling with the override lever and a lock link is rotatably attached to the inside release lever and is in communication with the lock lever via a reversing lever.

In another aspect, the latch assembly includes the catch that is rotatably attached to the latch assembly. The catch is movable between a latched position and an unlatched position to allow the vehicle door to be opened. Particularly, the catch moves along a guide within the latch assembly to move between the latched and unlatched positions. In response to a first movement of the latch (e.g., a first pull of the vehicle handle) of the vehicle door, the lock lever is rotated toward a cam gear attached to the latch assembly to disengage the override assembly. When the override assembly is disengaged, the override lever is decoupled from the inside release lever, the reversing lever is pushed away from the releasing lever, and the lock link contacts the releasing lever. After the first movement, the override assembly is again returned to an engaged state.

Further, in response to a second movement of the latch of the vehicle door, the override assembly is engaged, the releasing lever is pushed by the lock link to lift the pawl, and the hold open lever engages with the releasing lever. The engagement of the hold open lever with the releasing lever prevents the releasing lever from returning back to an engaged position and the pawl is lifted until the vehicle door is opened. The rotation of the catch during opening of the vehicle door causing interaction with the hold open lever via a cam surface and disengages the hold open lever, allowing the pawl and the release lever to return to an original position (e.g., a rest position) by spring force and allowing for the door to be re-closed.

In another aspect, in response to the first movement of the latch, the lock lever is rotated upward by the cam gear and the lock link is pushed away from the releasing lever while the override assembly remains disengaged to prevent the vehicle door from being unlocked. Also, in addition to the first movement of the latch, the spring is moved over a protrusion on the outer surface of the lock lever.

According to another aspect of the present disclosure, a method is provided for disengaging a latch assembly of a vehicle door. The method may include rotating a lock lever that interacts with an override assembly, toward a cam gear attached to the latch assembly, in response to a first movement of a latch of the vehicle door. An override lever of the override assembly that interfaces with the lock lever is decoupled from an inside release lever. A reversing lever is then pushed away from a releasing lever moveably attached to the latch assembly via a pawl. Further, a lock link is rotated toward the releasing lever wherein the lock link is rotatably attached to the inside release lever and is in communication with the lock lever via the reversing lever.

Furthermore, after the first movement, the override assembly is again returned to an engaged state. Then, in response to a second movement of the latch, the override assembly is engaged. The releasing lever is pulled by the hold open lever to lift the pawl. The hold open lever is then engaged with the releasing lever. Particularly, the engagement of the hold open lever with the releasing lever prevents the releasing lever from returning back to an engaged position and the pawl is lifted until the vehicle door is opened.

In another aspect, in response to the first movement of the latch, the lock lever is rotated upward by the cam gear and the lock link is pushed away from the releasing lever while the override assembly remains disengaged to prevent the vehicle door from being unlocked. Additionally, a spring coupled to the override lever is moved over a protrusion on an outer surface of the lock lever to maintain a position of the lock lever.

Notably, the present disclosure is not limited to the combination of the latch assembly elements as listed above and may be assembled in any combination of the elements as described herein.

Other aspects of the disclosure are disclosed infra.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

During normal operation (e.g., without failure) of a latch assembly, a latching mechanism is moveable in response to an electrical signal received for unlocking or locking a vehicle door. However, during a power failure the vehicle door is not capable of being unlock in such a manner since the electrical signal is not received. Accordingly, the present disclosure provides an improved latch assembly in which a release lever which is rotatable between a locked and unlocked position is used to mechanically unlock a latching member to thus prevent potential entrapment during an emergency (e.g., a vehicle accident or power failure).

Figure 1:
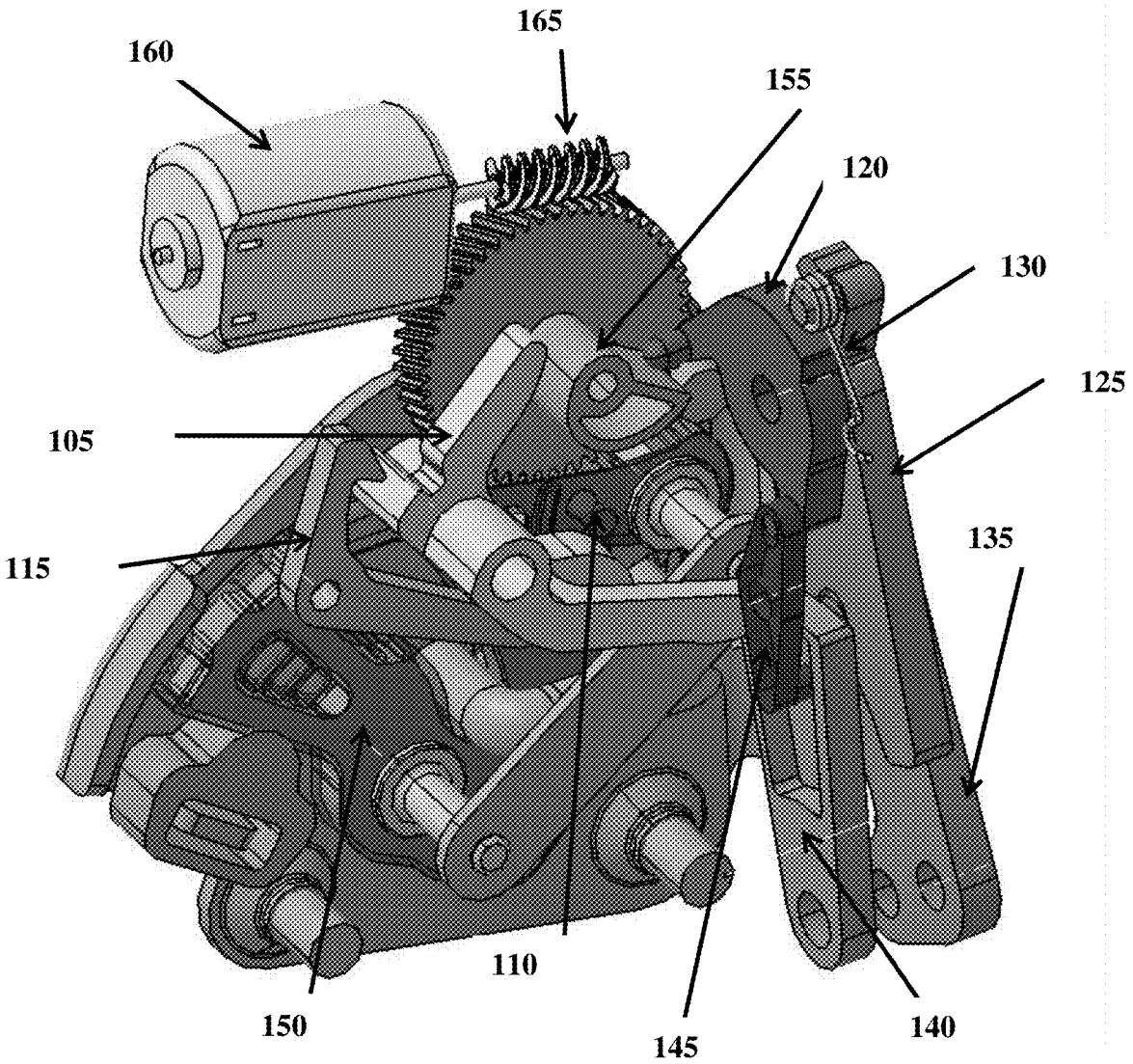
FIG. 1 is a perspective view of a latch assembly for a vehicle door according to an exemplary embodiment of the present disclosure.

In particular, according to one aspect, the present disclosure provides a latch assembly for a vehicle door which is capable of maintaining a child lock during normal operation (e.g., without failure), and a two-motion release feature during an emergency situation or power loss. As shown in FIG. 1, the latch assembly may include a releasing lever 105 that is moveably attached to the latch assembly by a rotatable pivot and interacts with a pawl 110. Additionally, a hold open lever 115 is engageable with the releasing lever 105 to maintain the releasing lever 105 in a disengaged position and the hold open lever 115 is also moveably secured to the latch assembly via a rotatable pivot and interacts with a catch 150. A lock lever 120 interacts with an override assembly to control whether the vehicle door is opened. In addition, the catch 150 is rotatably attached to the latch assembly and moveable between a latched position and an unlatched position to allow the vehicle door to be opened.

The override assembly may include an override lever 125 that interfaces with the lock lever 120 and a spring 130 that is coupled to the override lever 125 and is in communication with an outer surface of the lock lever 120 (e.g., slides along the surface of the lock lever). Additionally, the override assembly may include an inside release lever 135 capable of coupling and decoupling with the override lever 125 and a lock link 140 rotatably attached to the inside release lever 135 and in communication with the lock lever 120 via a reversing lever 145. The lock lever 120 may be moved to an unlocked position during a power failure by two movements of a vehicle handle or latch to be further described in detail below. The latch assembly may be operated by a motor 160 in communication with the assembly via a worm gear 165.

Figure 2:
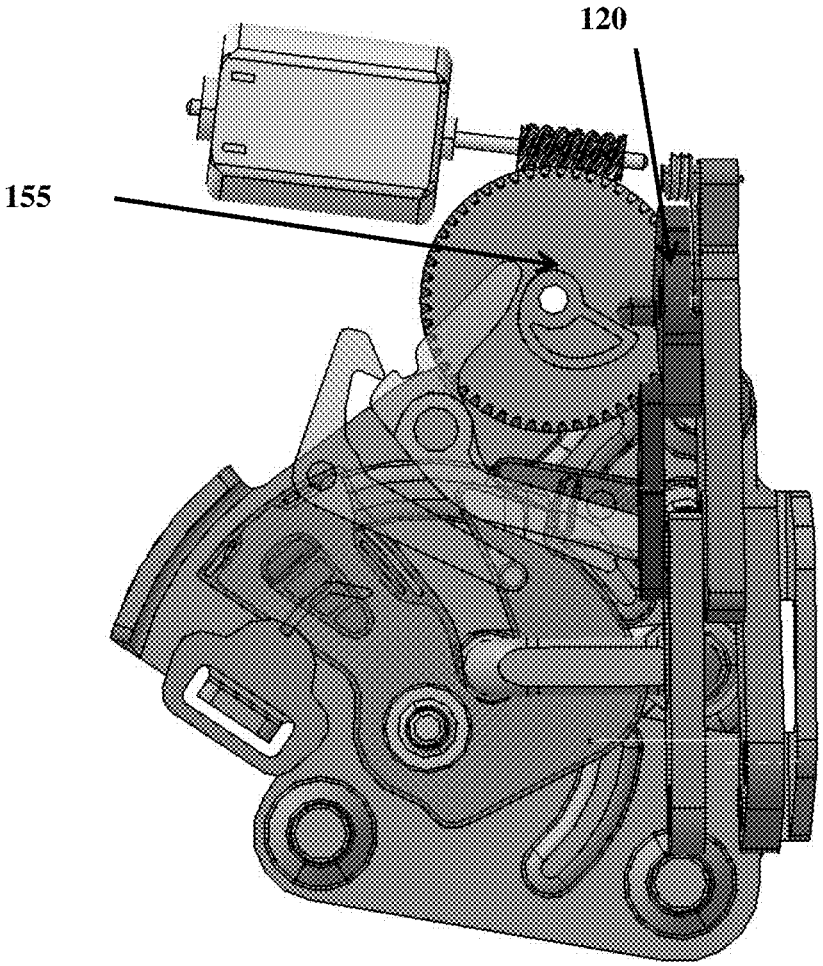
FIG. 2 is a view illustrating an unlocked state of the latch assembly for the vehicle door according to an exemplary embodiment of the present disclosure.
Figure 3A:
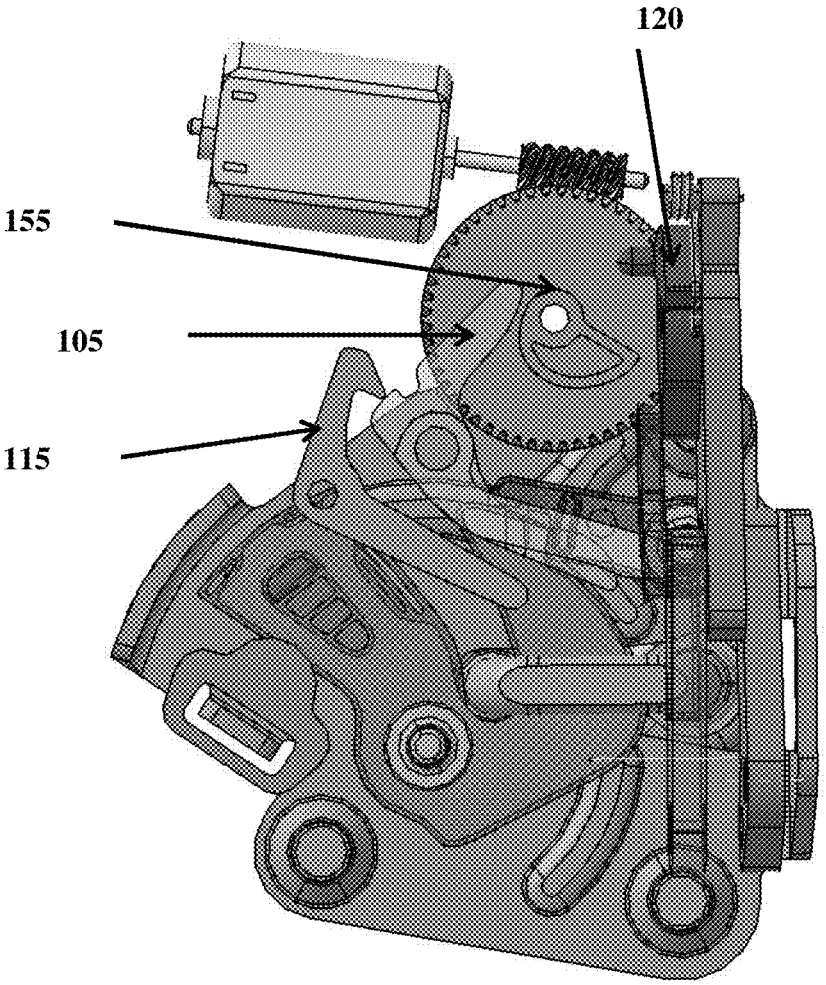
FIGS. 3A-3B are views illustrating a locked state of the latch assembly for the vehicle door according to an exemplary embodiment of the present disclosure.
Figure 3B:
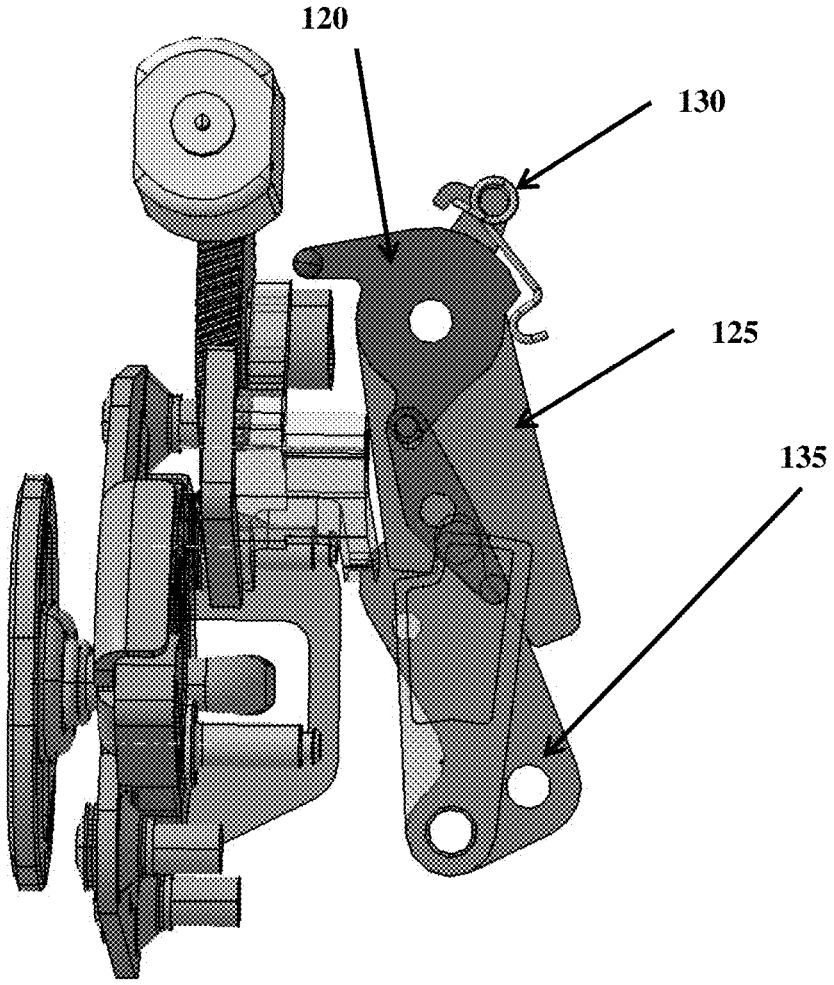

FIG. 2 illustrates a view of an unlocked state of the latch assembly for a vehicle door according to an exemplary embodiment of the present disclosure. As seen in FIG. 2, the lock lever 120 is rotated downwardly to disengage the override assembly and thus the lock lever 120 contacts the cam gear 155. The unlocked state of the latch assembly allows the vehicle door to be opened. FIGS. 3A-3B illustrate a view of a locked state of the latch assembly for a vehicle door according to an exemplary embodiment of the present disclosure. As shown in FIG. 3B, in the locked state of the vehicle door, that is, prior to a pull motion of the vehicle handle, the override assembly is engaged. In particular, the engagement of the override assembly indicates that the override lever 125 is engaged with the inside release lever 135 and the spring 130 maintains contact with the lock lever 120 in a locked position. Additionally, as seen in FIG. 3A, the lock lever 120 is disengaged from the cam gear 155 and the hold open lever 115 remains disengaged from the releasing lever 105.

Figure 4:
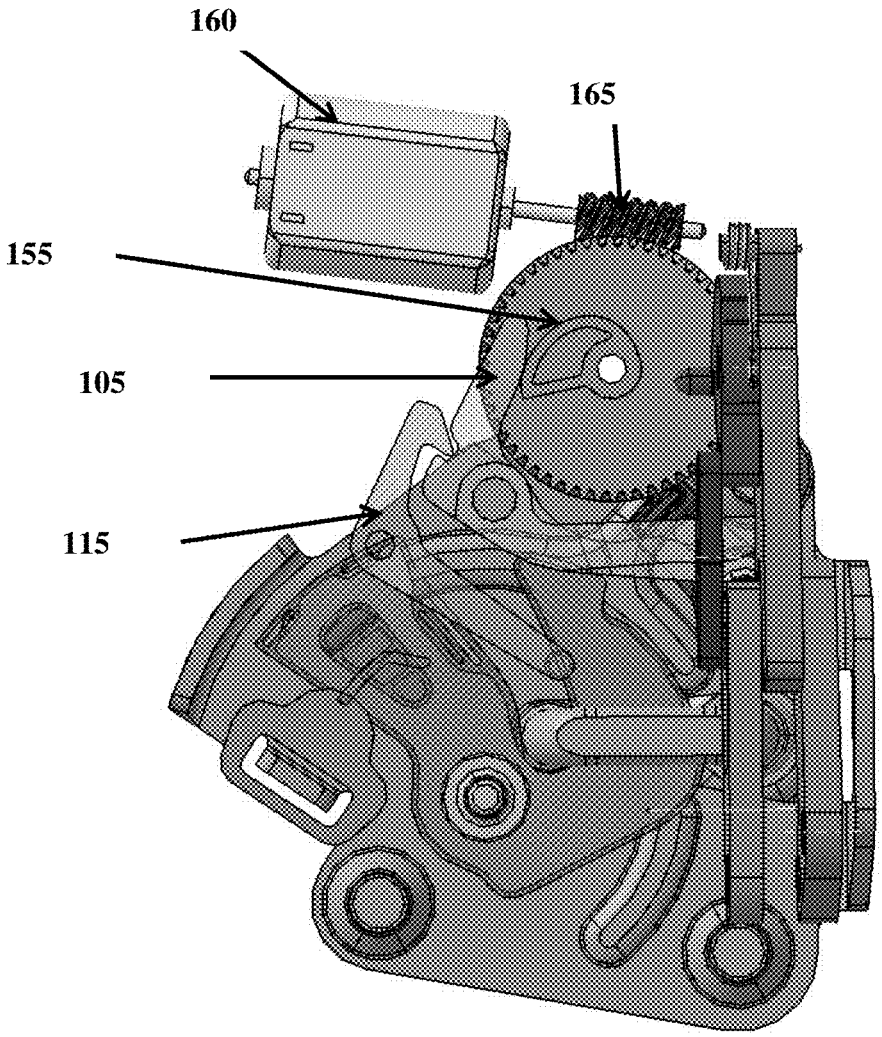
FIGS. 4-6 are views illustrating an electronic release of the latch assembly for the vehicle door according to an exemplary embodiment of the present disclosure.
Figure 5:
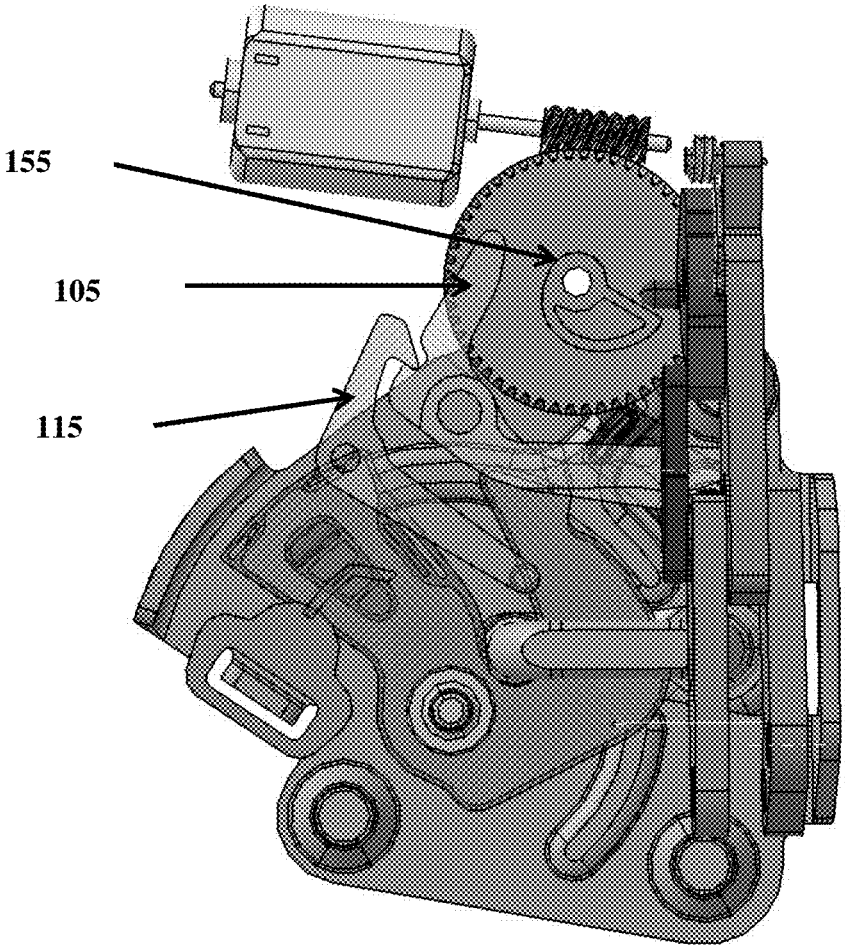
Figure 6:
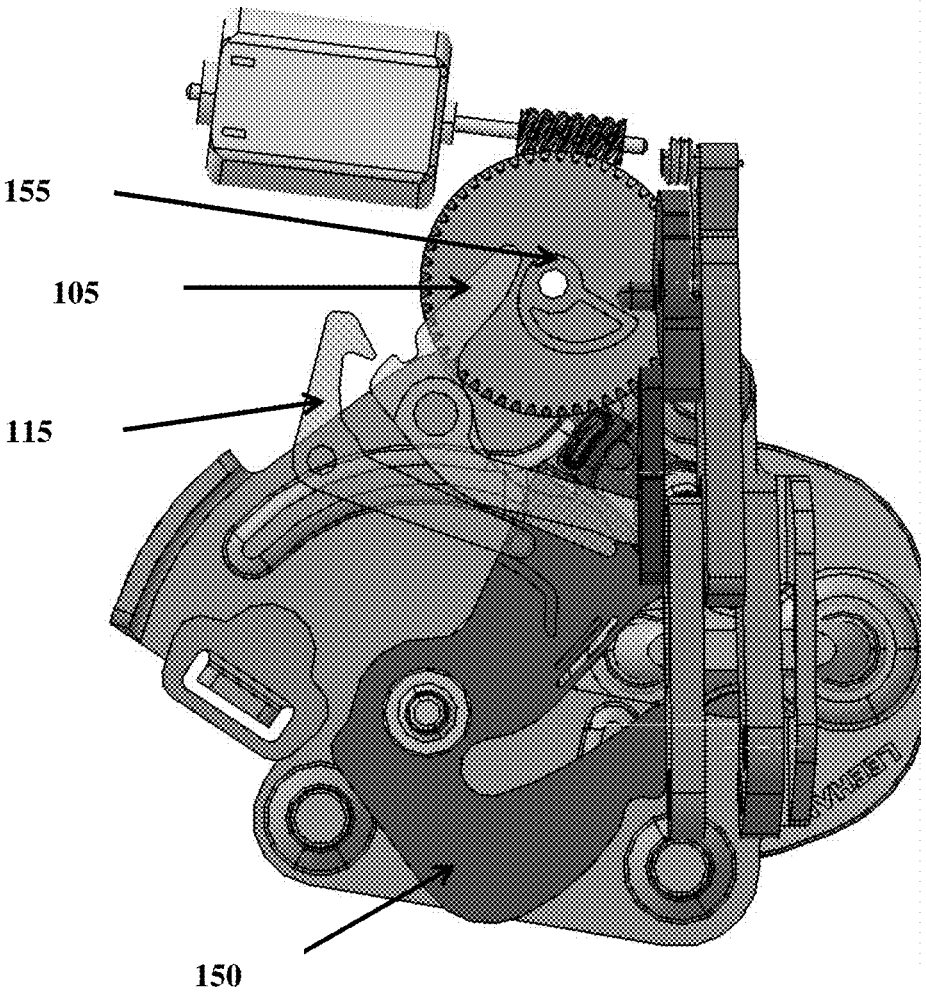

Further, FIGS. 4-6 illustrate an electronic release of the latch assembly for the vehicle door according to an exemplary embodiment of the present disclosure.

In particular, as seen in FIG. 4, the cam gear 155 is electrically rotated by the motor 160 (e.g., an actuator) via the worm gear 165 which disengages the pawl 110 when lifted by the releasing lever 105, and causes the hold open lever 115 to be engaged with the releasing lever 105 to unlatch the door latch assembly and hold the pawl 110 in the disengaged state. Then, as shown in FIG. 5, once the hold open lever 115 is engaged with the releasing lever 105 and the latch is unlocked, the cam gear 155 is rotated back to an original position by a bidirectional spring (not shown). During both of the operations as depicted in FIGS. 4 and 5, the override assembly remains in an engaged state. Lastly, as shown in FIG. 6, once the cam gear 155 is rotated back to the original position, the catch 150 is rotated along a guide in the latch assembly, the hold open lever 115 is released from the releasing lever 105 by an abutment cam surface on the catch 150, and the vehicle door may be opened allowing egress from the vehicle.

The configurations described herein above assume that the electric motor 160 receives energy or power via a controller to engage or disengage the lock lever 120. For example, when an inside vehicle handle is rotated to an unlock position and the child lock feature is detected to be on, the motor may be configured to return the system to a lock direction. When the child lock feature is detected to be in an off position, whether the vehicle is in a park position may be determined and if the vehicle speed is less than a particular speed, the latch assembly may be unlatched. However, when a power failure occurs (e.g., due to a vehicle accident) the vehicle door is not capable of being opened based on an electrical controller signal. Thus, according to an exemplary embodiment of the present disclosure, a mechanical override assembly may be included in the latch assembly as described above. In particular, the override assembly essentially delatches the lock lever by two distinct movements to allow the vehicle door to be manually or mechanically opened. Further, the requirement of two motions to override the locked latch assembly allows the override to meet legal requirements for rear doors, and allows a child lock feature to remain intact to prevent inadvertent release of the door lock when vehicle power is available.

Figure 7A:
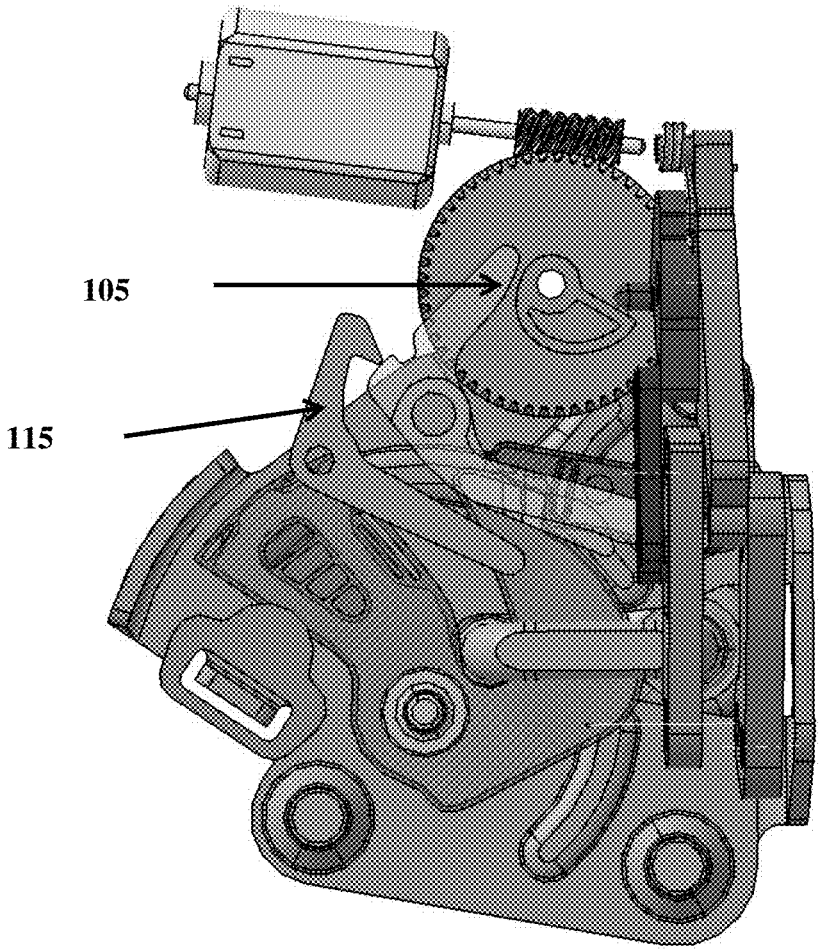
FIGS. 7A-7B are views illustrating the state of the latch assembly during a first movement according to an exemplary embodiment of the present disclosure.
Figure 7B:
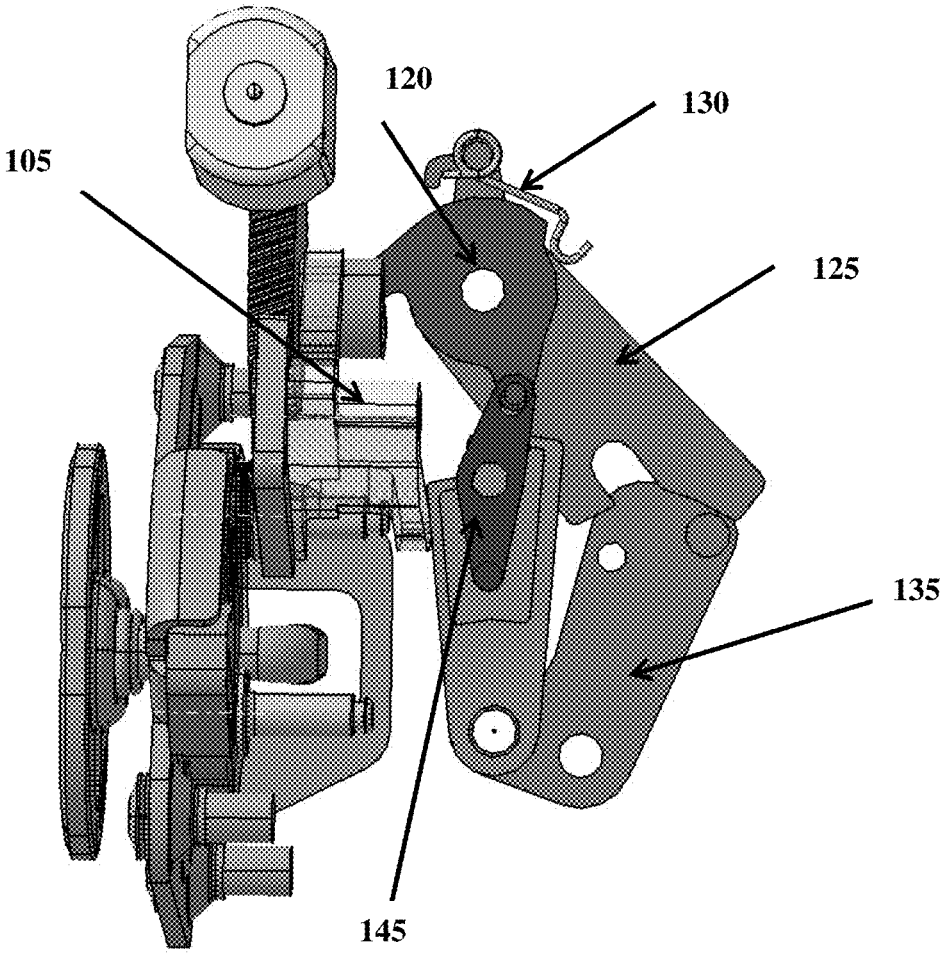

FIGS. 7A-7B illustrate a state of the latch assembly during a first movement according to an exemplary embodiment of the present disclosure. In particular, in FIGS. 7A-7B a power failure has occurred. As seen in FIG. 7A, the hold open lever 115 remains disengaged from the releasing lever 105. In response to the first movement (e.g., a pull motion) of the latch of the vehicle door, the lock lever 120 is rotated toward the cam gear 155 attached to the latch assembly, to disengage the override assembly. Further, as shown in FIG. 7B, the override lever 125 is released from (e.g., decoupled from) the inside release lever 135. In the disengagement of the override assembly, the reversing lever 145 is pushed away from the releasing lever 105 and the lock link 140 comes into contact with the releasing lever 105. The spring 130 (e.g., a clutch spring) is also moved along the outer surface of the lock lever 120 to push the lock lever 120 to the unlocked state.

Figure 8A:
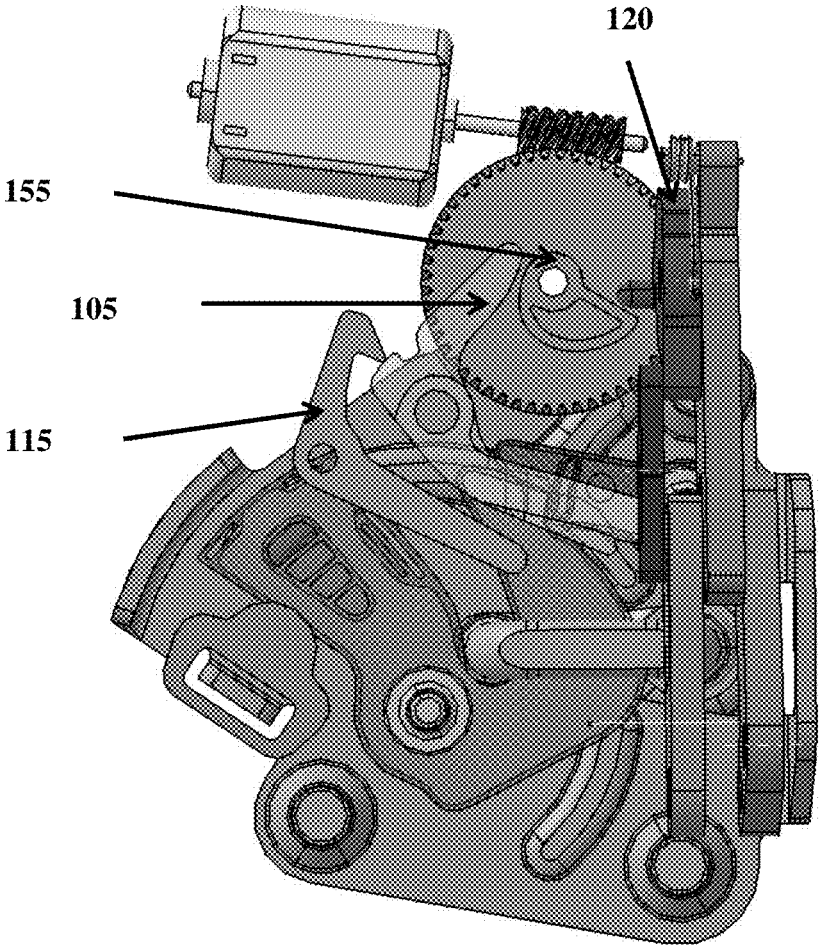
FIGS. 8A-8B are views illustrating the state of the latch assembly after a first movement according to an exemplary embodiment of the present disclosure.
Figure 8B:
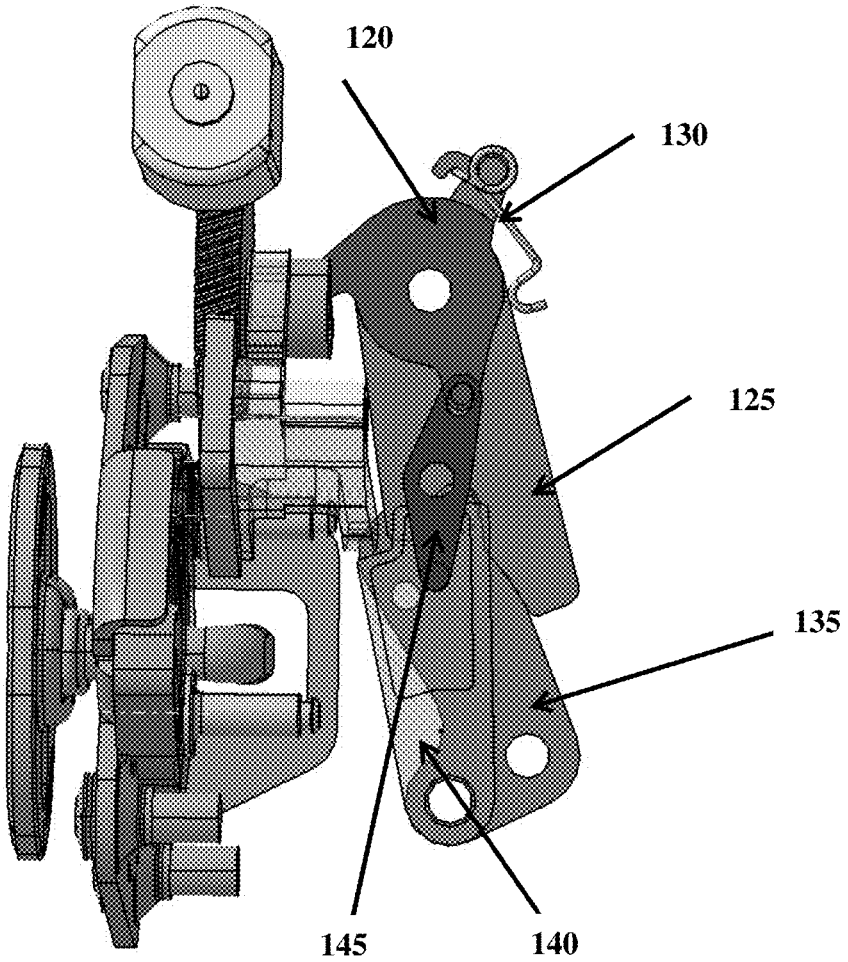

After the first movement, the override assembly is returned to an engaged position as seen in FIGS. 8A-8B. In other words, the override assembly remains disengaged until the inside handle (e.g., the latch of the vehicle door) is released. Upon release of the inside handle, the override assembly returns to the engaged state or position. As shown in FIG. 8A, the position of the lock lever 120 is maintained in the same state as shown in FIGS. 7A-7B, that is, the lock lever 120 remains in contact with the cam gear 155 and the hold open lever 115 remains disengaged from the releasing lever 105. However, as shown in FIG. 8B, the override assembly returns to an engaged state. In other words, after the first movement, the override lever 125 reengages with the inside release lever 135 while the spring 130 is moved along the outer surface of the lock lever 120. The engagement of the override lever 125 with the inside release lever 135 causes the inside release lever 135 to be rotated toward the lock link 140 which is attached to the lock lever 120 via a reversing lever 145. Thus, in this state, the vehicle door remains latched and the inside release is unlocked.

Figure 9A:
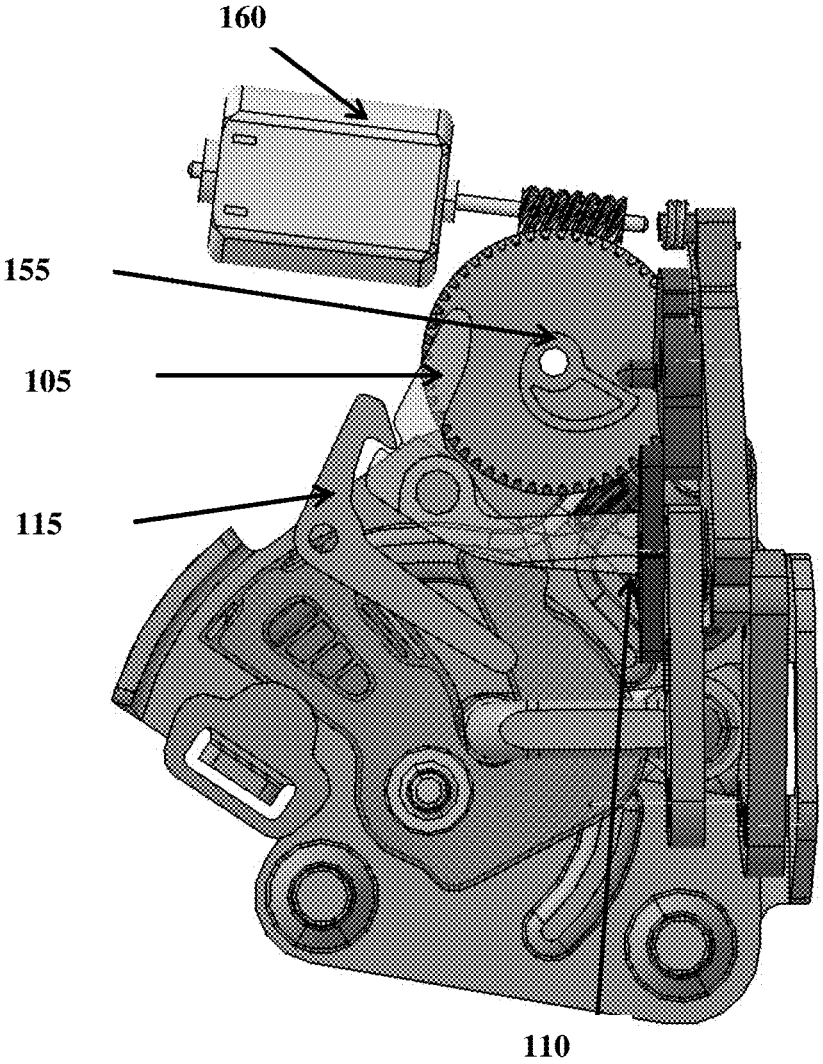
FIGS. 9A-9B are views illustrating the state of the latch assembly during a second movement according to an exemplary embodiment of the present disclosure.
Figure 9B:
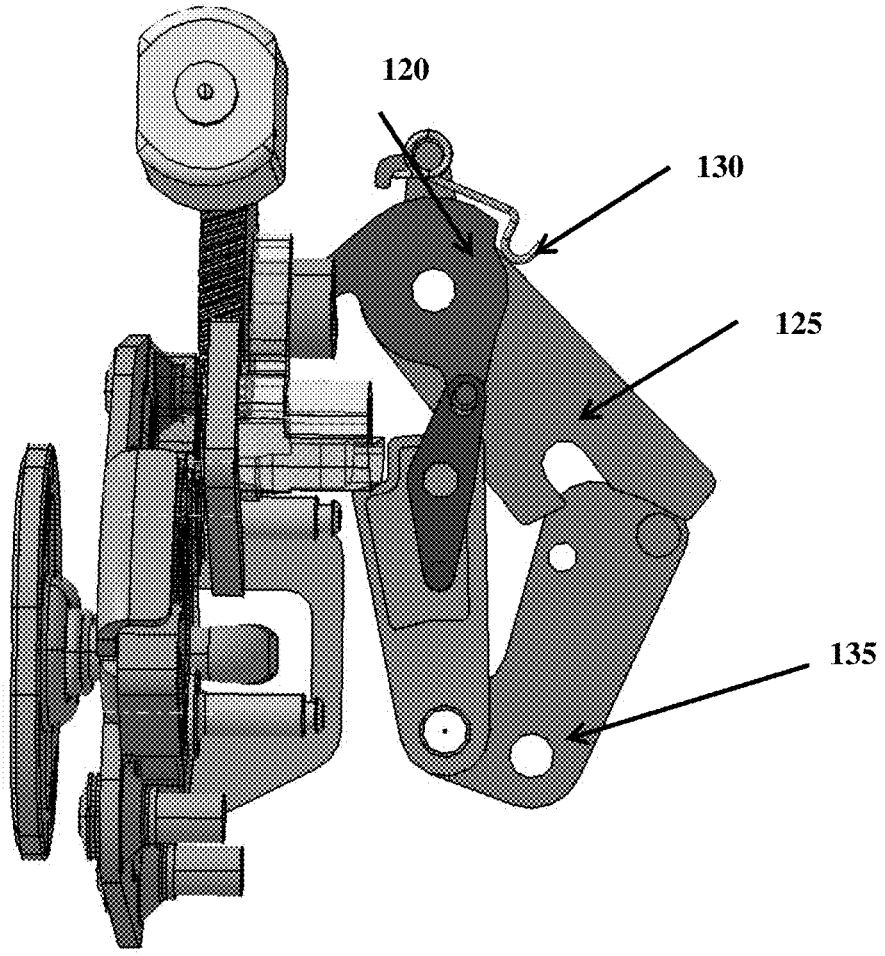

Referring now to FIGS. 9A-9B which show the state of the latch assembly during a second movement according to an exemplary embodiment of the present disclosure, the override assembly is again disengaged in the same manner as discussed previously. During the operation of FIGS. 9A-9B the cam gear 155 remains in a constant position since, due to the power failure, the motor 160 is not operated to provide rotation to the cam gear 155. Additionally, in response to the second movement of the latch of the vehicle door, the releasing lever 105 is pulled back by the hold open lever 115 to lift the pawl 110 and the hold open lever 115 is engaged with the releasing lever 105, to hold the releasing lever 105 in place as the pawl 110 is lifted until the vehicle door is opened. In particular, the engagement of the hold open lever 115 with the releasing lever 105 prevents the releasing lever 105 from returning back to an engaged position. This response to the second motion allows passengers within a vehicle to safely exit the vehicle during power failure without being required to find a separate back up mechanism to release the door lock.

According to another exemplary embodiment of the present disclosure, a child lock feature is also capable of being maintained despite continuous pulling motions being detected. For example, when a child in the rear seat of the vehicle continuously pulls on the latch of the vehicle door (e.g., the inside handle), in a conventional latch with a two motion override, the lock override feature is blocked from locking by the inside release lever. Accordingly, the latch may not be electrically relocked until the inside release lever is fully returned to a rest state. In addition, when an occupant moves the handle back and forth rapidly; the actuator may not be able to relock prior to an inadvertent release of the door. However, the override cancel feature of the present disclosure is capable of maintaining the locked state of the latch assembly even during partial inside handle motion, and even when held continuously in the fully traveled position. In other words, the latch assembly is capable of being relocked after a mechanical override motion at any point of inside handle operation thus preventing the child lock safety feature from being defeated.

In a further exemplary embodiment of the present disclosure, the latch may feature a lock state sensing switch or sensor configured to detect a change of the lock state which triggers a cancellation motion of the lock actuator. In conventional latches, repeated cycling of the motor of the latch assembly may cause the motor to overheat thus causing damage to the latch assembly, such as an electrical failure and as a result, the vehicle door may inadvertently open. However, the use of the lock state sensing switch, in addition to allowing the initiation of the override cancellation, may be used to cut off the current supplied to the motor once the lock state is confirmed again and prevent excess current which may overheat the motor. Further, the use of the hold open lever 115 and a sensor or state switch mounted on the pawl 110, or the hold open lever 115, or the releasing lever 105 also allows the motor current to be controlled to the minimum required for unlatching and thus assisting with prevention of heat buildup in the motor. However, such a feature is not required to obtain the benefits of the override cancellation as described hereinabove.

Figure 10A:
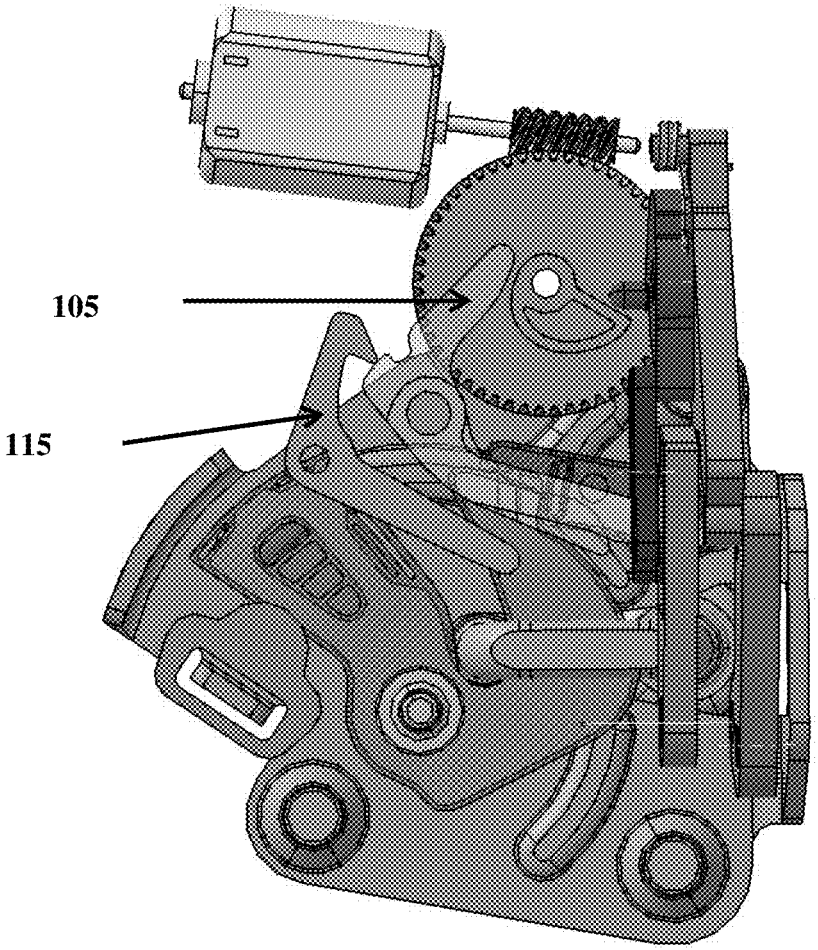
FIGS. 10A-10B are views illustrating the latched and unlocked latch assembly during a first movement according to an exemplary embodiment of the present disclosure.
Figure 10B:
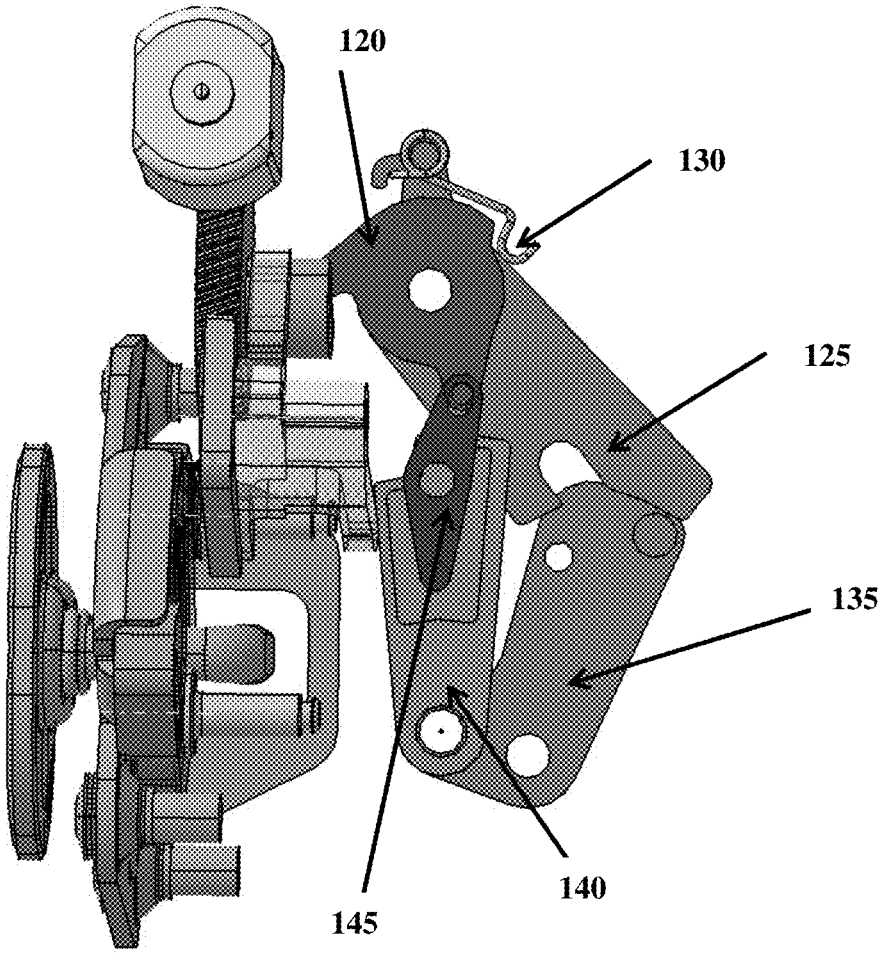

FIGS. 10A-10B illustrate the unlatched and unlocked latch assembly according to an exemplary embodiment of the present disclosure. In particular, FIGS. 10A-10B illustrate when the latch is unlocked and the inside release is activated (e.g., a first movement or pull motion). The response to the first movement in this exemplary embodiment is similar to the response described in relation to FIGS. 7A-7B. In particular, the hold open lever 115 remains disengaged from the releasing lever 105. Additionally, the override assembly is disengaged until the inside handle is released. As previously described and as shown in FIG. 10A, the disengaged state of the override assembly includes the disengagement of the override lever 125 from the inside release lever 135.

Figure 11A:
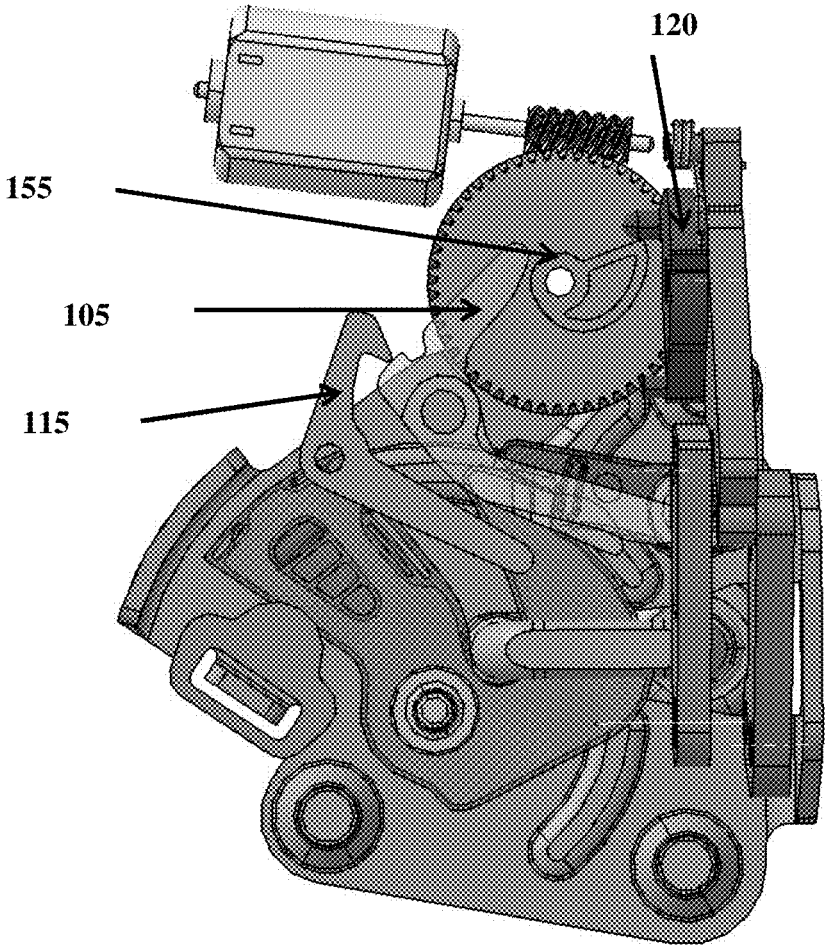
FIGS. 11A-11B are views illustrating a latched latch assembly state with a simultaneous disengagement of the override lever and the locking lever during a first movement according to an exemplary embodiment of the present disclosure.
Figure 11B:
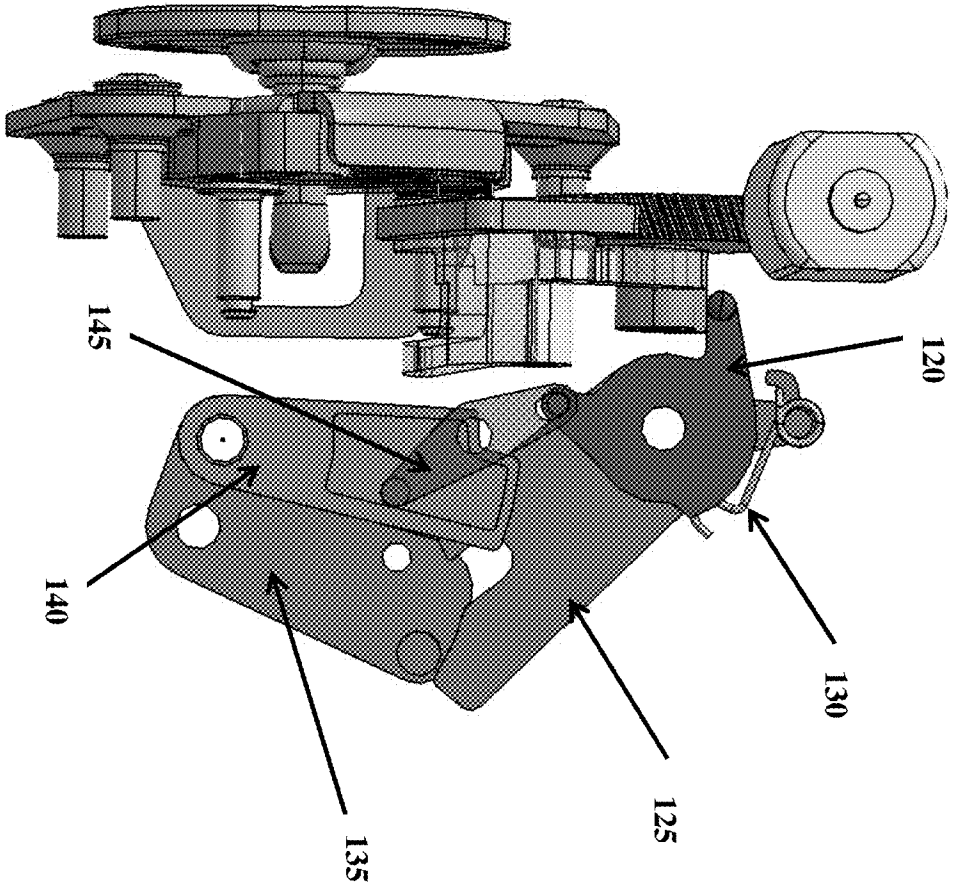

However, the response to the first movement, or a second movement (e.g. a second pull on the inside handle) is different than previously described and reflects the override cancel feature of the present disclosure. In particular, FIGS. 11A-11B illustrate a latched latch assembly state with the override of an opening of the vehicle door according to an exemplary embodiment of the present disclosure. In response to the second movement of the latch (e.g., the second pull on the inside handle), the lock lever 120 is rotated upward by the cam gear 155 and the lock link 140 is pushed away from the releasing lever 105 to prevent the vehicle door from being unlocked. Specifically, although the override assembly remains disengaged, the spring 130 is moved over the protrusion on the outer surface of the lock lever 120 by the rotation of the lock lever 120. The rotation of the lock lever 120 also causes the reversing lever 145 to rotate toward the latch assembly, thus causing the reversing lever 145 to be pushed away from the latch assembly. Accordingly, the vehicle door remains in a locked state although the inside handle (or outside handle) is pulled multiple times (e.g., two or more pulls) or held continuously in a single pull. In the configuration as described above in relation to FIGS. 10A-11B, a child lock feature is capable of remaining enabled despite multiple pulls of a door handle (e.g., a vehicle door latch).

As discussed above, the latch assembly of the present disclosure is capable of reducing the cost and weight of an emergency release system as well as removing the requirement of a hidden release cable as a mechanical backup. The particular design of the latch assembly in the present disclosure merely requires one motor and omits the need for backup power supply. Accordingly, during a power failure the latch assembly is capable of overriding an e-latch using a double pull motion to prevent entrapment during emergency situations. The latch assembly is also capable of maintaining a child lock by using an electronic actuator of a latch to cancel an unlocking motion, thus providing enhanced safety to passengers within the vehicle. Additionally, the maintaining of the child lock feature together with the described mechanical override feature, and a lock state sensor, prevent the motor from overheating due to continuous use or pull of a vehicle door from the inside.

Hereinabove, although the present disclosure is described by specific matters such as concrete components, and the like, the exemplary embodiments, and drawings, they are provided merely for assisting in the entire understanding of the present disclosure. Therefore, the present disclosure is not limited to the exemplary embodiment. Various modifications and changes may be made by those skilled in the art to which the disclosure pertains from this description. Therefore, the spirit of the present disclosure should not be limited to the above-described exemplary embodiments, and the following claims as well as all technical spirits modified equally or equivalently to the claims should be interpreted to fall within the scope and spirit of the disclosure.

What is claimed is:

1. A latch assembly for a vehicle door, comprising:

a releasing lever moveably attached to a latch via a pawl and moveable between an engaged and disengaged position to unlatch the latch assembly; and a lock lever that interacts with an override assembly to control whether the vehicle door is opened, wherein the override assembly is manually operated in response to an inside handle being pulled, wherein the override assembly operation includes a first pull operation of the inside handle to move the lock lever to an unlocked position and a second pull operation of the inside handle to open the latch during a power failure of a motor, and wherein the override assembly further includes:

an override lever interfacing with the lock lever;

an inside release lever being capable of coupling and decoupling with the override lever; and a lock link rotatably attached to the inside release lever and in communication with the lock lever via a reversing lever.

2. The latch assembly of claim 1, further comprising:

a hold open lever engageable with the releasing lever to maintain the releasing lever in a disengaged position, the hold open lever moveably secured to the latch assembly via a rotatable pivot.

3. The latch assembly of claim 1, further comprising:

a catch rotatably attached to the latch assembly, the catch being moveable between a latched position and an unlatched position to allow the vehicle door to be opened.

4. The latch assembly of claim 3, wherein in response to a first movement of a latch of the vehicle door, the lock lever is rotated toward a cam gear attached to the latch assembly to disengage the override assembly.

5. The latch assembly of claim 4, wherein in the disengagement of the override assembly, the override lever is decoupled from the inside release lever, the reversing lever is pushed away from the releasing lever, and the lock link contacts the releasing lever.

6. The latch assembly of claim 5, wherein after the first movement of the latch, the override assembly is again engaged.

7. The latch assembly of claim 6, wherein in response to a second movement of the latch of the vehicle door, the override assembly is engaged, the releasing lever is pushed by the lock link to lift the pawl, and the hold open lever engages with the releasing lever.

8. The latch assembly of claim 7, wherein the engagement of the hold open lever with the releasing lever prevents the releasing lever from returning back to an engaged position and the pawl is lifted until the vehicle door is opened.

9. The latch assembly of claim 6, wherein in response to the first movement of the latch, the lock lever is rotated upward by the cam gear and the lock link is pushed away from the releasing lever while the override assembly remains disengaged to prevent the vehicle door from being unlocked.

10. The latch assembly of claim 9, wherein in response to the first movement of the latch, a spring coupled to the override lever and in communication with an outer surface of the lock lever is moved over a protrusion on the outer surface of the lock lever to maintain a position of the lock lever.

11. The latch assembly of claim 3, wherein the catch moves along a guide within the latch assembly to move between the latched and unlatched positions.

12. A method of overriding a latch assembly of a vehicle door to disengage the latch assembly during a power failure of a powered actuator of the latch assembly, comprising:

in response to a first movement of a latch of the vehicle door, rotating a lock lever that interacts with an override assembly, toward a cam gear attached to the latch assembly to disengage the override assembly;

decoupling an override lever of the override assembly that interfaces with the lock lever from an inside release lever;

pushing a reversing lever away from a releasing lever moveably attached to the latch assembly via a pawl; and rotating a lock link toward the releasing lever, wherein the lock link is rotatably attached to the inside release lever and in communication with the lock lever via the reversing lever, wherein after the first movement, the override assembly is engaged again, and wherein in response to a second movement of the latch of the vehicle door, the method includes:

engaging the override assembly;

pushing the releasing lever by the lock link to lift the pawl; and engaging a hold open lever with the releasing lever;

wherein the engagement of the hold open lever with the releasing lever prevents the releasing lever from returning to an engaged position and the pawl is lifted until the vehicle door is opened, and wherein the hold open lever is moveably secured to the latch assembly.

13. The disengaging method of claim 12, further comprising:

in response to the first movement of the latch, rotating the lock lever upward by the cam gear; and rotating the lock link away from the latch assembly while maintaining the override assembly in the disengaged state to prevent the vehicle door from being unlocked.

14. The disengaging method of claim 13, further comprising:

moving a spring coupled to the override lever over a protrusion on an outer surface of the lock lever to maintain a position of the lock lever.

* * * * *